US006450831B2

(12) United States Patent
Aoyama et al.

(10) Patent No.: US 6,450,831 B2
(45) Date of Patent: Sep. 17, 2002

(54) TERMINAL FITTING WITH CRIMPING PIECES AND PORTIONS FOR RESTRICTING WIRE MOVEMENT

(75) Inventors: Masahiko Aoyama; Eiji Kojima, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/885,852

(22) Filed: Jun. 20, 2001

(30) Foreign Application Priority Data

Jun. 29, 2000 (JP) ..... 2000-196456

(51) Int. Cl.[7] ..... H01R 4/24; H01R 4/26; H01R 11/20

(52) U.S. Cl. ..... 439/399; 439/867; 439/882

(58) Field of Search ..... 439/399, 407, 439/867, 882, 877

(56) References Cited

U.S. PATENT DOCUMENTS

| | | | | | |
|---|---|---|---|---|---|
| 2,302,767 | A | | 11/1942 | Hackbarth | 439/423 |
| 2,668,950 | A | | 2/1954 | Bohaboy et al. | 29/753 |
| 3,728,665 | A | * | 4/1973 | Frey | 439/882 |
| 3,798,347 | A | * | 3/1974 | Harding et al. | 438/882 |
| 4,050,760 | A | * | 9/1977 | Cohen | 439/399 |
| 5,137,468 | A | | 8/1992 | Murakami | 439/433 |
| 5,139,434 | A | * | 8/1992 | Goodman | 439/399 |
| 5,549,483 | A | * | 8/1996 | Hotea | 439/399 |
| 5,599,212 | A | | 2/1997 | Sawada | 439/843 |

FOREIGN PATENT DOCUMENTS

| | | |
|---|---|---|
| EP | 0 632 528 | 1/1995 |

* cited by examiner

*Primary Examiner*—Brian Sircus
*Assistant Examiner*—Javaid Nasri
(74) *Attorney, Agent, or Firm*—Anthony J. Casella; Gerald E. Hespos

(57) ABSTRACT

A terminal fitting (T) has a pair of crimping pieces (17A, 17B) that extend up from opposite side edges of a bottom wall (11), and are crimped into connection with a wire (W) placed on the bottom wall (11). The crimping pieces (17A, 17B) are offset to each other in the longitudinal direction of the wire (W). Restricting portions (18A, 18B) are formed on the bottom wall (11) and restrict a lateral displacement of the wire (W) against pushing forces acting on the wire (W) from the crimping pieces (17A, 17B) in directions normal to the longitudinal direction of the wire (W) while the crimping pieces (17A, 17B) are being crimped into connection with the wire (W).

17 Claims, 8 Drawing Sheets

(A)

(B)

(A)

(B)

(A)

(B)

TERMINAL FITTING WITH CRIMPING PIECES AND PORTIONS FOR RESTRICTING WIRE MOVEMENT

BACKGROUND OF THE INVENTION

1. Field of the Invention

The present invention relates to a terminal fitting that has a crimping portion for crimped connection with a wire.

2. Description of the Related Art

A known terminal fitting that has a crimping portion for crimped connection with a wire is disclosed in U.S. Pat. No. 5,599,212. This known terminal fitting has a bottom wall and a crimping portion formed by two crimping pieces that extend up from opposite side edges of the bottom wall. The crimping pieces can be wound around a wire disposed on the bottom wall to achieve a crimped connection with the wire. The crimping pieces are offset to each other in the longitudinal direction of the wire to avoid a mutual interference when they are crimped. Thus, several kinds of wires of different diameters can be handled.

Crimping pieces that are offset have one crimping piece at each of two positions on the wire. This configuration results in a fastening force that is lower than a case where two crimping pieces are crimped together in one position.

To strengthen the fastening force, it may be considered to increase a degree of deformation of the crimping pieces when they are crimped. Thus, the outer diameters of the wire and the crimping pieces are made smaller when the wire is fastened. However, the lateral pushing force exerted on the wire by the crimping piece increases as the degree of deformation for crimping increases. Thus, the wire is pushed sideways from its proper fastened position. As a result, the resin coating is pushed out between the leading end of the crimping piece and the side edge of the bottom wall opposite from this crimping piece. In a worst case, the pushed-out coating may be cut.

In view of the above, an object of the invention is to prevent a lateral displacement of a wire due to pushing forces exerted by the crimping pieces.

SUMMARY OF THE INVENTION

The invention is directed to a terminal fitting with a bottom wall that has opposite first and second side edges. First and second crimping pieces extend up from the respective first and second side edges of the bottom wall, and can be wound around a wire placed on the bottom wall. The crimping pieces are offset to each other in the longitudinal direction of the wire. The terminal fitting further comprises restricting portions for engaging the wire placed on the bottom wall to restrict a lateral displacement of the wire against transverse pushing forces exerted on the wire by the crimping pieces during the crimping of the crimping pieces.

The restricting portions may be offset relative to each other, and may be displaced from a transverse center position to sides opposite the corresponding crimping pieces.

The restricting portions may be formed by embossing the bottom wall. Alternatively, the restricting portions may be formed by embossing the side walls extending upward from the side edges of the bottom walls or by making cuts in portions of the side walls and bending these cut portions inwardly. Still further, the restricting portions may be formed by embossing corners between the bottom wall and the side walls.

The restricting portions prevent lateral displacement of the wire even if there are large lateral pushing forces exerted on the wire due to the crimping of the crimping pieces.

The restricting portions are disposed in offset arrangement, and hence the wire lies in an S-shape on the bottom wall after crimping. Thus, a loose movement of the wire in its longitudinal direction can be restricted even if a longitudinal pulling force acts on the wire.

DETAILED DESCRIPTION OF THE PREFERRED EMBODIMENTS

Figure 1:
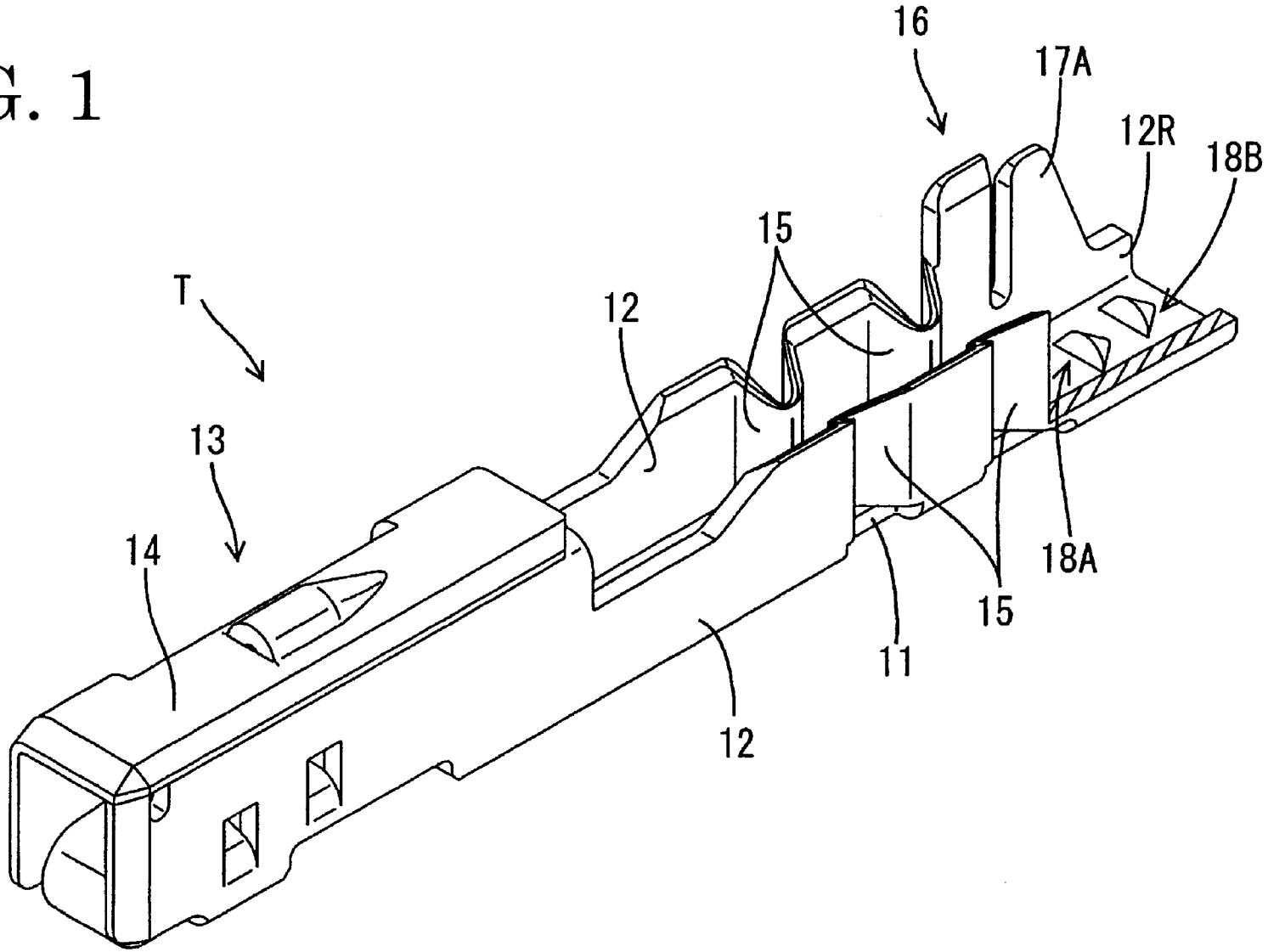
FIG. 1 is a perspective view of a first embodiment.

An insulation-displacement terminal fitting T according to a first embodiment of the invention is illustrated in FIGS. 1–5, and is produced by bending and embossing a conductive metallic plate material that has been stamped or cut into a specified shape. The insulation-displacement terminal fitting T is narrow in forward and backward directions, and has a bottom wall 11 with first and second side edges. First and second side walls 12 extend upward from the opposite side edges of the bottom wall 11 over its entire length.

An engaging portion 13 is formed at the front half of the terminal fitting T for connection with a mating male terminal fitting (not shown). The engaging portion 13 is comprised of the bottom wall 11, the side walls 12 and first and second ceiling walls 14. The first and second ceiling walls 14 extend inwardly from the upper edges of the respective first and second side walls 12 and are placed one over the other to form a rectangular tube that extends in forward and backward directions.

Insulation-displacement portions 15 are formed rearwardly of the engaging portion 13. The insulation-displacement portions 15 are formed by embossing the respective side walls 12 inwardly to define bent projecting ends 15A in the space between the respective side walls 12. Two pairs of the insulation-displacement portions 15 are provided one after the other along the longitudinal direction of the terminal fitting T. A wire W can be aligned parallel to the longitudinal direction of the terminal fitting T and pushed transversely between the insulation-displacement portions 15. Thus, the bent projecting ends 15A of the insulation-displacement portions 15 will cut open a resin coating Wa of the wire W. Further pushing of the wire W will cause the bent projecting ends 15A to bite into the cut-open sections of the resin coating Wa and to contact a core Wb of the wire W. The insulation displacement portions can take forms other than the specific shapes described above and illustrated in the FIGS. 1–4. Additionally, the step of insulation displacement can be performed simultaneously with, before or after a crimping step to be described later.

A crimping section 16 is formed adjacent the rear end of the terminal fitting T for crimped connection with the wire W. The crimping section 16 includes a rear end portion of the bottom wall 11 and first and second rear end portions 12R of the respective first and second side walls 12. The rear end portions 12R of the side walls 12 project a shorter distance from the bottom wall 11 than portions of the side walls 11 forward of the crimping section 16. First and second crimping pieces 17A and 17B extend up from upper edges of the respective first and second rear end portions 12R of the side walls 12. The first crimping piece 17A is at the front of the first rear end portion 12R, whereas the second crimping piece 17B is at the rear of the second rear end portion 12R. Thus, the first and second crimping pieces 17A, 17B are offset from each other in the longitudinal direction of the terminal fitting T.

First and second substantially triangular pyramidal restricting portions 18A and 18B are embossed on the bottom wall 11 and project into the wire-receiving space between the side walls 12. The first and second restricting portions 18A and 18B are located to align substantially with the respective first and second crimping pieces 17A and 17B. Thus, the first and second restricting portions 18A and 18B are spaced longitudinally along the insulation-displacement terminal fitting T. The restricting portions 18A and 18B both are offset from the longitudinal center of the bottom wall 11. More particularly, the first restricting portion 18A is at a location on the bottom wall 11 closer to the second side wall 12 than to the first side wall 12. Similarly, the second restricting portion 18B is at a location on the bottom wall 11 closer to the first side wall 12 than to the second side wall 12.

Each restricting portion 18A, 18B has a longitudinal ridge 19R that extends in forward and backward directions, and two transverse ridges 19F that extend laterally from the front end of the longitudinal ridge 19R. A front locking surface 19S is defined in front of the transverse ridges 19F of each restricting portion 18A, 18B and extends substantially normal to the longitudinal direction of the terminal fitting T.

The wire W can be disposed between the crimping pieces 17A and 17B with the longitudinal axis of the wire W oriented in forward and backward directions. The wire W then is moved normal to its longitudinal direction and is placed on the bottom wall 11. Subsequently, as shown in FIG. 5(B), the crimping pieces 17A, 17B are wound around the outer surface of the wire W and are deformed and curved arcuately inwardly. In this way, the crimping portion 16 is crimped into connection with the wire W.

The crimping pieces 17A, 17B are crimped into connection with the wire W in two positions because of the longitudinal offset between the two crimping pieces 17A, 17B. As a result, the crimping operation causes the respective crimping pieces 17A or 17B to exert lateral forces on the wire W. More particularly, the crimping causes the first crimping piece 17A to urge the wire W toward the second side wall 12. Similarly, the crimping causes the second crimping piece 17B to urge the wire W toward the first side wall 12.

Figure 2:
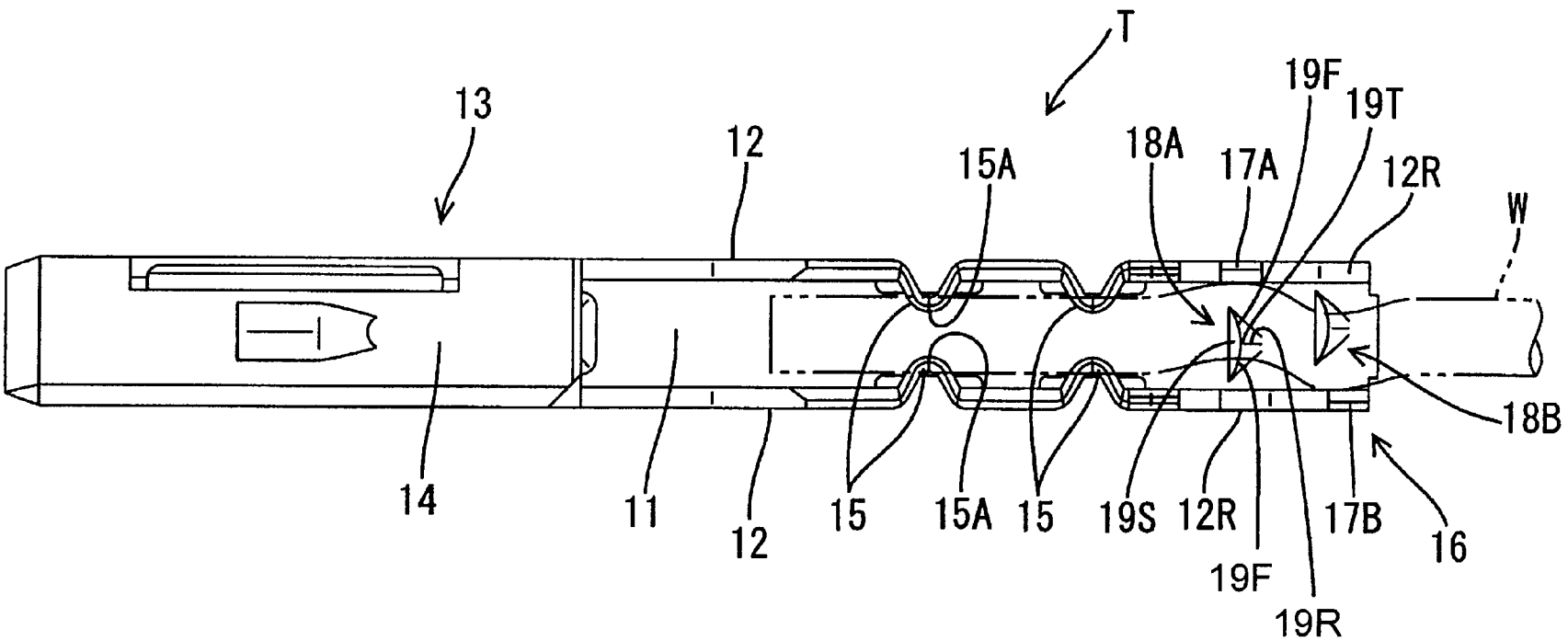
FIG. 2 is a plan view of the first embodiment.
Figure 3:
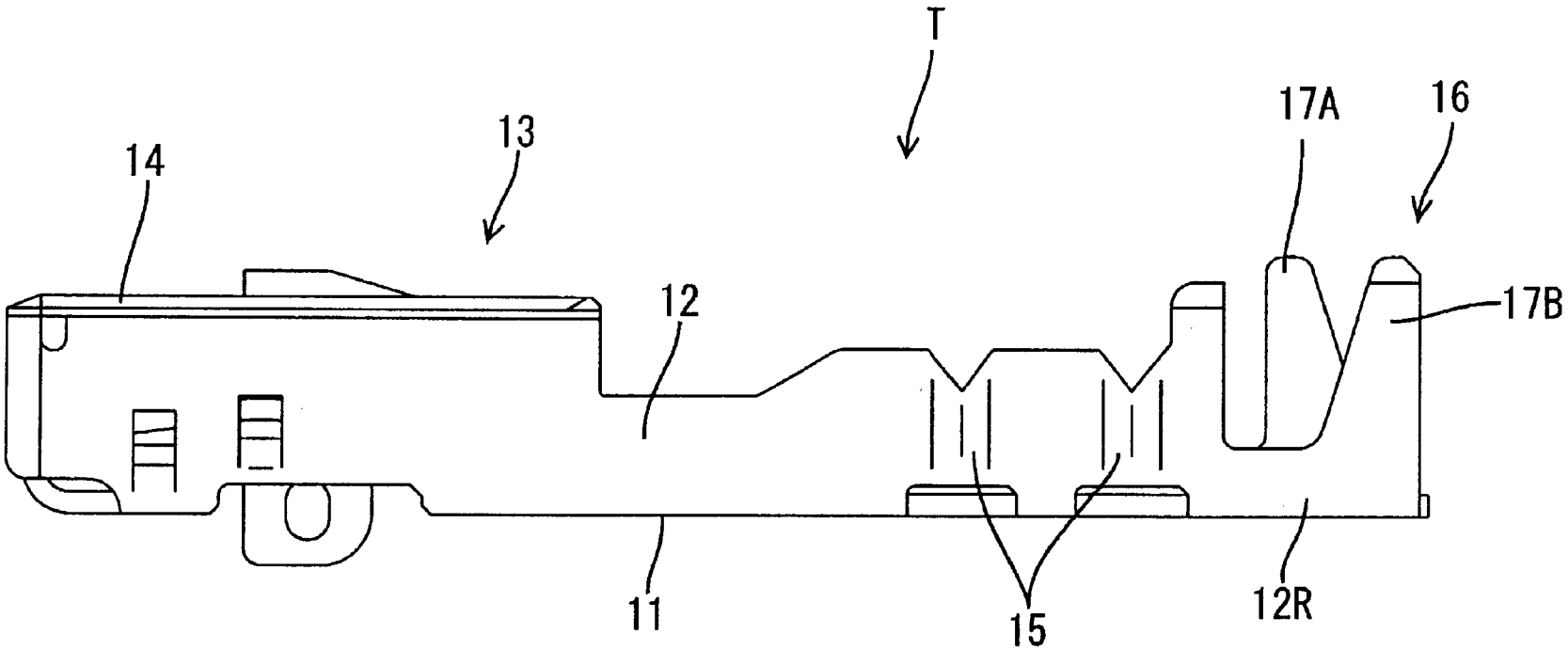
FIG. 3 is a side view of the first embodiment.
Figure 4:
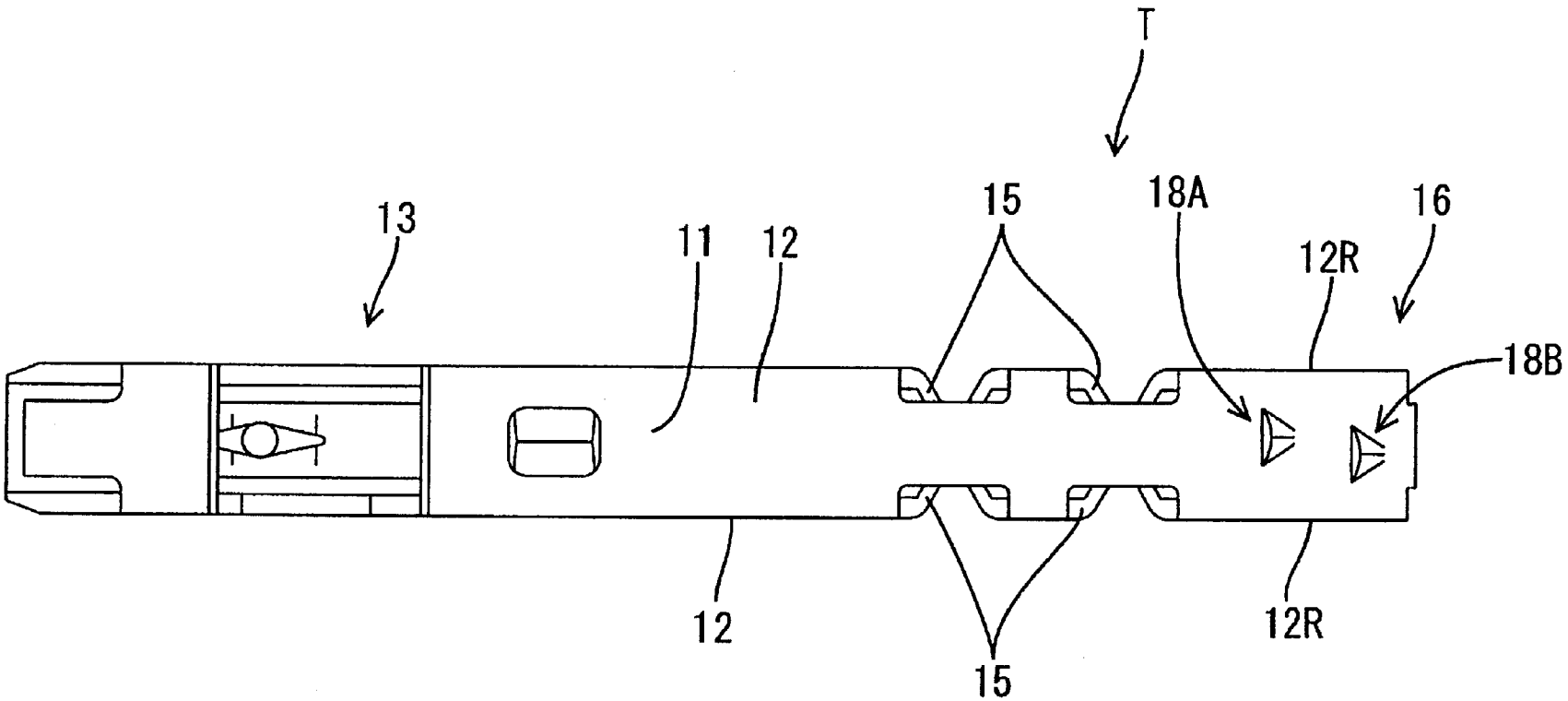
FIG. 4 is a bottom view of the first embodiment.
Figure 5:
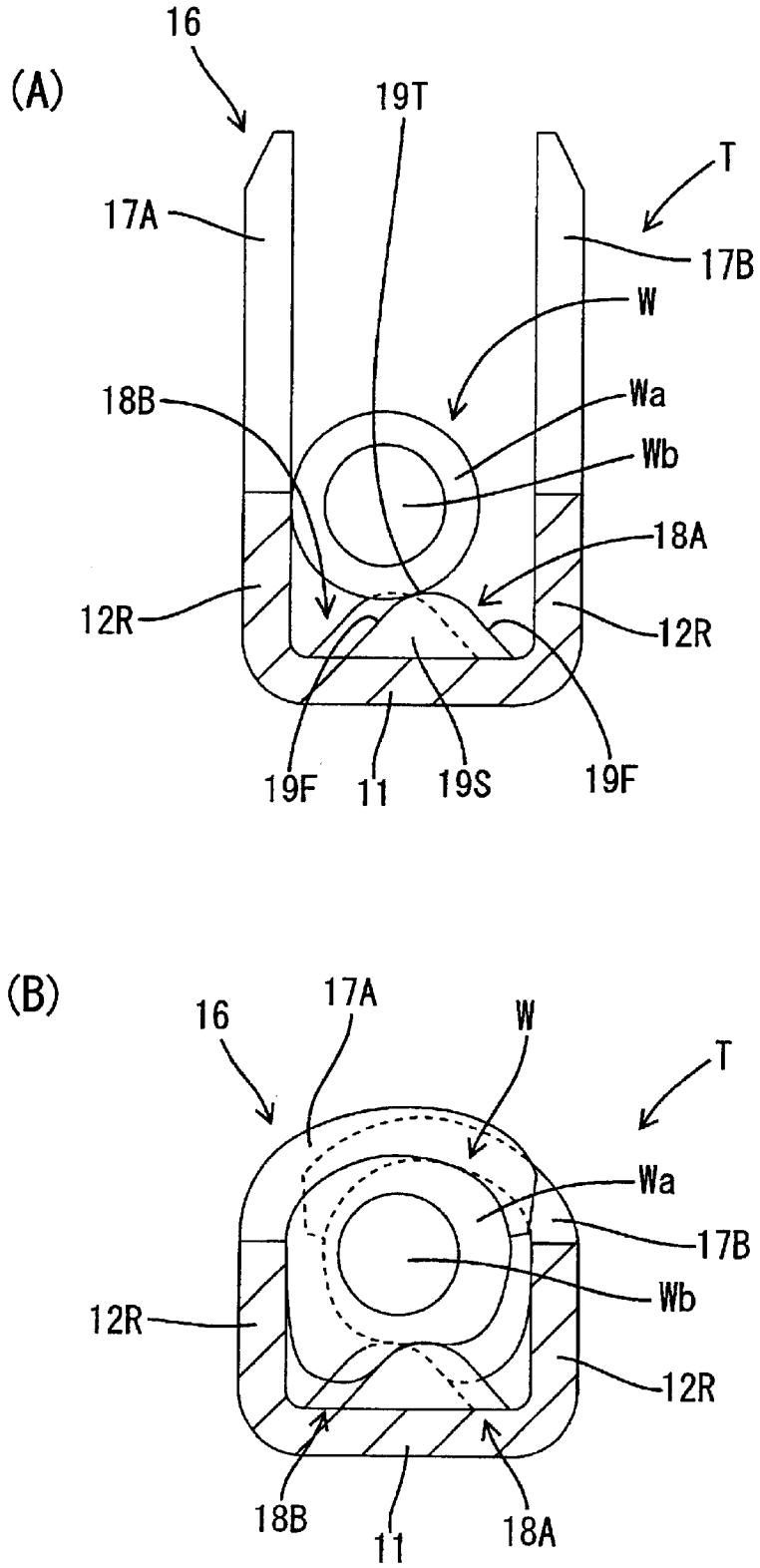
FIGS. 5(A) and 5(B) are lateral sections showing states before and where a wire is fastened, respectively.

Clearances between the inner surfaces of the side walls 12 and the wire W would permit the wire W to be displaced laterally in response to the pushing force from the crimping piece 17A or 17B, if there were no restricting portions 18A and 18B. Such a lateral displacement of the wire W could cause the resin coating Wa of the wire W to be pushed out between the leading end of the crimping piece 17A or 17B and the upper edge of the side wall 12 at the side of the bottom wall 11 opposite from the crimping piece 17A or 17B. In a worst case, the pushed-out resin coating Wa may be cut. However, the first and second restricting portions 18A, 18B on the bottom wall 11 prevent excessive lateral displacement of the wire W. Thus, portions of the wire W that are crimped by the first crimping piece 17A contact the first restricting portion 18A and are held in a position offset from the transverse center and toward the first crimping piece 17A, as shown in FIGS. 2 and 5B. Similarly, portions of the wire W that are crimped by the second crimping piece 17B contact the second restricting portion 18A and are held in a position offset from the transverse center and toward the second crimping piece 17B. As a result, a section of the wire W at and near the restricting portions 18A, 18B defines a slightly S-shaped or zig-zag line due to the crimping, as shown in FIG. 2.

As explained above, the crimping pieces 17A, 17B exert lateral pushing forces on the wire W during the crimping operation. However, the wire W is received by the restricting portions 18A, 18B at the side of the wire W opposite from the crimping piece 17A, 17B that gives the pushing force. Thus, the wire W is held against the lateral pushing force and without significant lateral displacement.

The transverse offset of the restricting portions 18A and 18B achieves another significant advantage. More particularly, the first restricting portion 18A is at a front position with respect to the longitudinal direction of the wire W and is displaced toward a second side of the longitudinal center. The second restricting portion 18B is at a rear position with respect to the longitudinal direction of the wire W and is displaced to a first side of the longitudinal center. Thus, the two restricting portions 18*a*, 18B are in an offset arrangement. Accordingly, the crimped wire W assumes an S-shape or zigzag configuration relative to the longitudinal axis of the terminal fitting T. The two transversely offset restricting portions 18A and 18B resist pulling forces in the longitudinal direction of the wire W. Therefore, a loose movement of the wire W in its longitudinal direction is restricted.

As explained above, each restricting portion 18A, 18B is substantially in the form of a triangular pyramid and the front locking surface 19S of each restricting portion 18A, 18B extends substantially normal to the longitudinal direction of the wire W. The resin coating Wa of the wire W is hooked by the locking surfaces 19S and the restricting portions 18A, 18B bite into the resin coating Wa in response to any backward pulling force on the wire W. Thus, a loose movement of the wire W can be restricted effectively against the pulling force.

Figure 6:
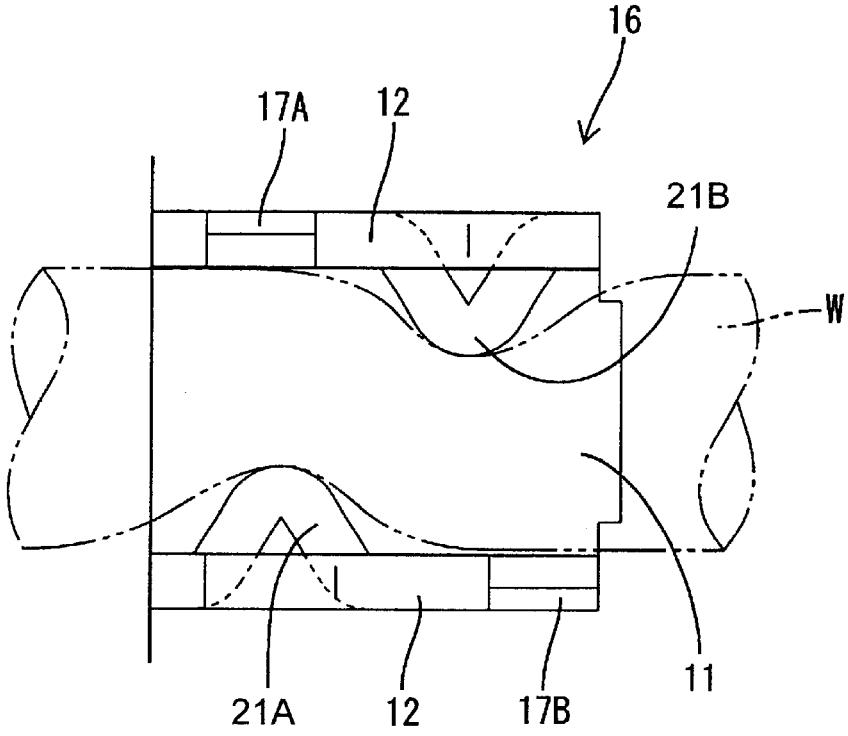
FIGS. 6(A) and 6(B) are a partial plan view and a partial perspective view of a second embodiment, respectively.
Figure 6:
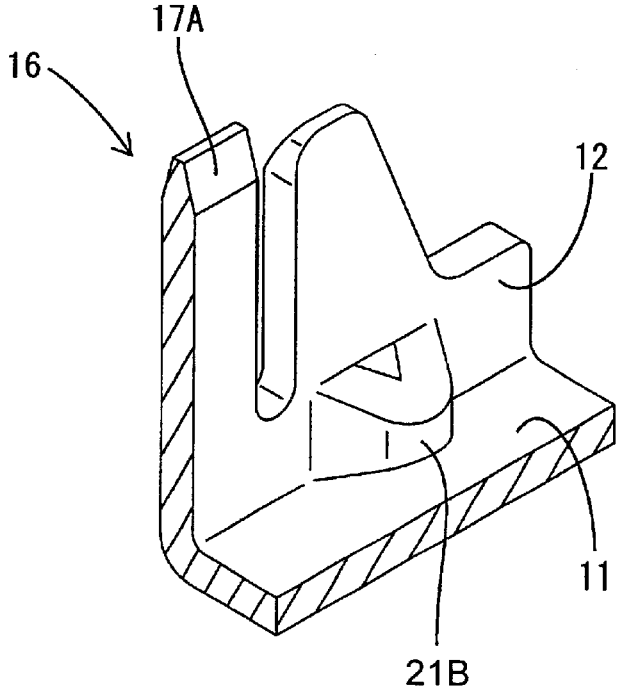

A second embodiment of the present invention is described with reference to FIG. 6. The second embodiment differs from the first embodiment in the construction of the restricting portions. Other elements of the second embodiment are the same as in the first embodiment. Accordingly, no description is given on the structure, action and effects of these similar elements, and they are merely identified by the same reference numerals as in the first embodiment.

Restricting portions 21A, 21B of the second embodiment are formed by embossing portions of the side walls 12 near the bottom wall 11 to project inwardly. The positional relationship between the first and second crimping pieces 17A and 17B and the first and second restricting pieces 21A and 21B with respect to forward and backward directions and transverse directions are the same as in the first embodiment.

Figure 7:
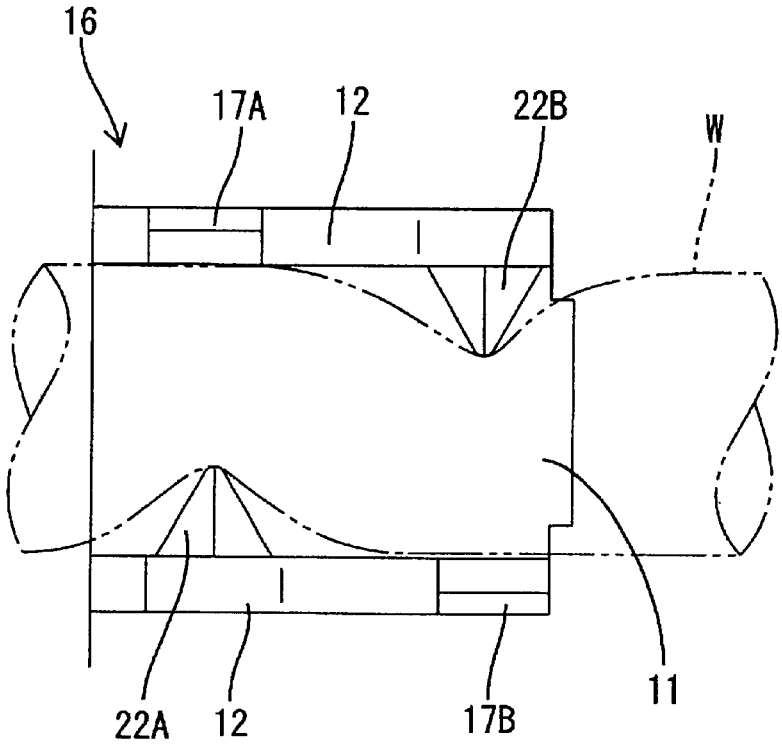
FIGS. 7(A) and 7(B) are a partial plan view and a partial perspective view of a third embodiment, respectively.
Figure 7:
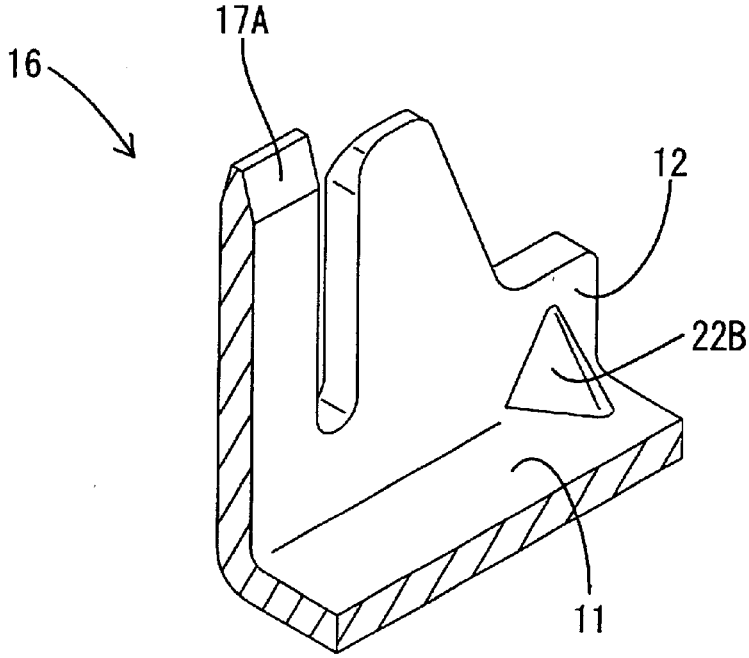

A third embodiment of the invention is described with reference to FIG. 7. The third embodiment also differs from the first embodiment in the construction of the restricting portions. Other elements, however, are substantially the same as in the first embodiment. Accordingly, no description is given of the structure, action and effects of these similar elements, and these similar elements merely are identified by the same reference numerals as in the first embodiment.

Restricting portions 22A, 22B of the third embodiment are formed by embossing corners between the bottom wall 11 and the side walls 12 so that the restricting portions 22A, 22B stand from the side edges of the bottom walls 11 and project inwardly. The positional relationship between the first and second crimping pieces 17A and 17B and the positional relationship between the first and second restricting portions 22A and 22B with respect to forward and backward directions and transverse directions are the same as in the first embodiment.

Figure 8:
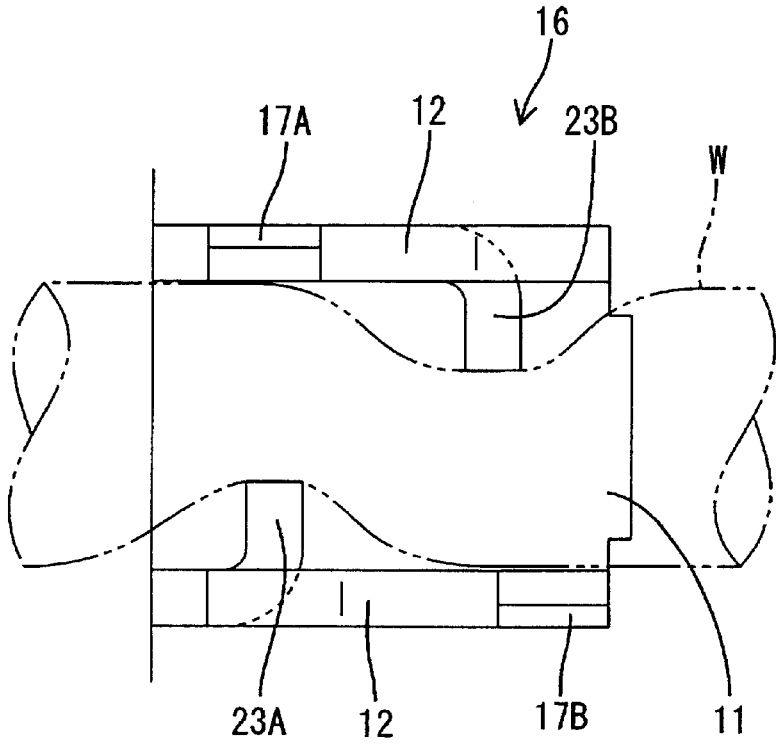
FIGS. 8(A) and 8(B) are a partial plan view and a partial perspective view of a fourth embodiment, respectively.
Figure 8:
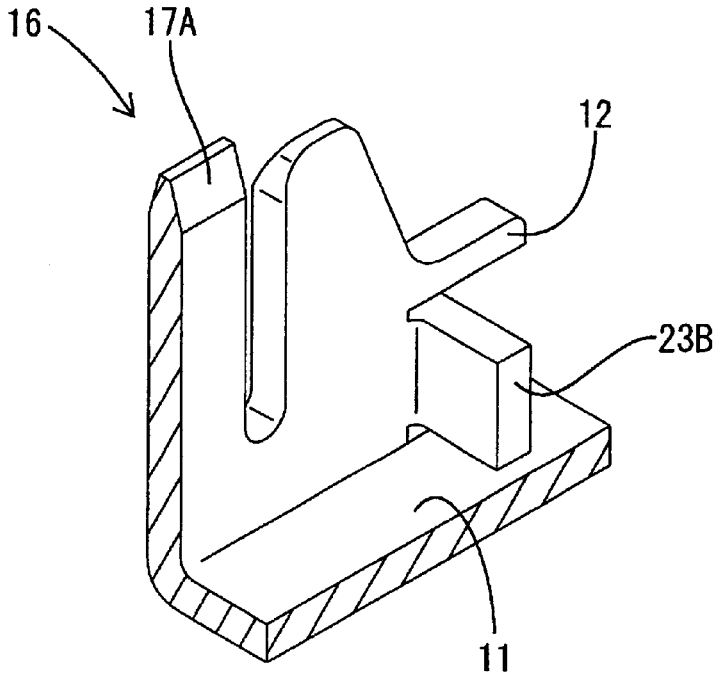

A fourth embodiment of the present invention is described with reference to FIG. 8. The fourth embodiment differs from the first embodiment in the construction of the restricting portions. Since the other construction is same as in the first embodiment, no description is given on the structure, action and effects thereof, and these similar elements merely are identified by the same reference numerals as in the first embodiment.

Restricting portions 23A, 23B of the fourth embodiment are formed by making cuts in portions of the side walls 12 substantially adjacent the bottom wall 11 and bending the cut portions inwardly. The restricting portions 23A, 23B are rectangular when viewed along the longitudinal direction of the wire W, and extend in directions normal to both the side walls 12 and the bottom wall 11. The positional relationships between the first and second crimping pieces 17A and 17B and between the first and second restricting portions 23A and 23B with respect to forward and backward directions and transverse directions are the same as in the first embodiment.

The present invention is not limited to the above described and illustrated embodiment. For example, the following embodiments are also embraced by the technical scope of the present invention. Beside the following embodiments, various changes can be made without departing the sprit of the present invention.

The preceding embodiments relate to terminal fittings with a crimping portion. However, disclosed restricting portions also may be applied to terminal fittings with no crimping portion.

The preceding embodiments provide the restricting portions to the right or left from the longitudinal center position. However, the restricting portions may be provided in the longitudinal center according to the present invention.

The restricting portions are formed by embossing the bottom wall in the foregoing embodiments. However, the restricting portions may be formed by cutting the bottom wall and bending cut portions inwardly according to the present invention.

What is claimed is:

1. A terminal fitting with an elongated bottom wall having opposite first and second side edges, said bottom wall having a longitudinal axis centrally between the side edges, first and second crimping pieces extending up from the respective first and second side edges of the bottom wall and being longitudinally displaced from one another along the bottom wall, first and second restricting means substantially adjacent the bottom wall, the first restricting means being aligned with the first crimping piece and being closer to the second side edge than to the first side edge, the second restricting means being aligned with the second crimping piece and being closer to the first edge than to the second side edge, the first and second restricting means being for restricting lateral displacement of a wire in response to forces exerted by crimping the respective crimping portions into engagement with the wire and for urging the wire into a zigzag configuration.

2. The terminal fitting of claim 1, wherein the restricting means are embossed into the bottom wall.

3. The terminal fitting of claim 1, further comprising opposed first and second side walls projecting up from the respective first and second side edges of the bottom wall.

4. The terminal fitting of claim 3, wherein the first and second restricting means are embossed into the respective first and second side walls and into portions of the bottom wall adjacent the respective first and second side walls.

5. The terminal fitting of claim 1, wherein the first and second restricting means are unitary with the respective second and first side walls.

6. The terminal fitting of claim 1, wherein the restricting means each having a locking surface substantially normal to the longitudinal axis.

7. The terminal fitting of claim 6, wherein each said restricting means is a substantially triangular pyramid embossed in the bottom wall.

8. The terminal fitting of claim 1, wherein said bottom wall is free projections between said first and second restricting means and first and second side edges.

9. The terminal fitting of claim 1, wherein said bottom wall is substantially planar at locations between said first restricting means portion and first side edge and at locations between said second restricting means and said second side edge.

10. A terminal fitting having opposite front and rear ends, an engaging portion defined adjacent the front end configured for engaging a mating terminal, a crimping portion defined adjacent the rear end, the crimping portion comprising an elongated bottom wall having opposite first and second side edges and a longitudinal axis substantially centrally between the side edges, first and second crimping pieces extending up from the respective first and second side edges of the bottom wall and being longitudinally displaced from one another along the crimping portion, first and second restricting portions substantially adjacent the bottom wall and aligned respectively with the first and second crimping pieces, each restricting portion having a locking surface substantially normal to the longitudinal axis and substantially facing the front end of the terminal fitting, the first and second restricting portions being offset on opposite respective sides of the longitudinal axis, such that the first restricting portion being closer to the second side edge than to the first side edge, and the second restricting portion being closer to the first side edge than to the second side edge, whereby the offset of the restricting portions on opposite sides of the longitudinal axis urges a wire places on the bottom wall into a zigzag configuration.

11. The terminal fitting of claim 10, wherein the restricting portions are embossed into the bottom wall.

12. The terminal fitting of claim 10, further comprising opposed first and second side walls projecting up from the respective first and second side edges of the bottom wall.

13. The terminal fitting of claim 12, wherein the first and second restricting portions are embossed into the respective second and first side walls and into portions of the bottom wall adjacent the respective first and second side walls.

14. The terminal fitting of claim 10, wherein the first and second restricting portions are unitary with the respective second and first side walls, and wherein said bottom wall is free of any projections between said first and second restricting portions and the respective first and second crimping pieces.

15. The terminal fitting of claim 10, further comprising and insulation displacement portion between the engaging portion and the crimping portion.

16. The terminal fitting of claim 10, wherein said bottom wall is substantially planar at locations between said restrictions portion and said first side edge and at locations between and second crimping portion and said second side edge.

17. A terminated wire comprising:

terminal fitting having opposite front and rear ends, an engaging portion defined adjacent the front end and configured for engaging a mating terminal, a crimping potion defined adjacent the rear end, the crimping portion comprising an elongated bottom wall having opposite first and second side edges and a longitudinal axis substantially centrally between the side edges, first and second crimping pieces extending up from the respective first and second side edges of the bottom wall and being longitudinally displaced from one another along the crimping portion, first and second restricting portions substantially adjacent the bottom wall and aligned respectively with the first and second crimping pieces, the first and second restricting portions being offset an opposite respective sides of the longitudinal axis, such that the first restricting portion is closer to the second side edge than to the first side edge, and the second restricting portion is closer to the first side edge than to the second side edge; and a wire crimped between the first crimping piece and the first restricting portion and between the second crimping piece and the second restricting portion such that said wire defines a zigzag configuration through said crimping portion of said terminal fitting.

* * * * *